US010434559B2

(12) United States Patent
Iwano et al.

(10) Patent No.: US 10,434,559 B2
(45) Date of Patent: Oct. 8, 2019

(54) PRESS APPARATUS AND SPRAY NOZZLE

(71) Applicant: TOYOTA JIDOSHA KABUSHIKI KAISHA, Toyota-shi, Aichi-ken (JP)

(72) Inventors: Yoshihiro Iwano, Toyota (JP); Junichi Komatsu, Toyota (JP); Shigeaki Ando, Toyota (JP); Masaru Hashimoto, Miyoshi (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 444 days.

(21) Appl. No.: 14/895,958

(22) PCT Filed: Jun. 5, 2014

(86) PCT No.: PCT/IB2014/000987
§ 371 (c)(1),
(2) Date: Dec. 4, 2015

(87) PCT Pub. No.: WO2014/195792
PCT Pub. Date: Dec. 11, 2014

(65) Prior Publication Data

US 2016/0114373 A1 Apr. 28, 2016

(30) Foreign Application Priority Data

Jun. 5, 2013 (JP) ..... 2013-118993

(51) Int. Cl.
*B21D 37/16* (2006.01)
*B05B 1/02* (2006.01)
(Continued)

(52) U.S. Cl.
CPC ..... *B21D 37/16* (2013.01); *B05B 1/02* (2013.01); *B21D 22/022* (2013.01); *B21D 22/208* (2013.01); *B05B 1/06* (2013.01)

(58) Field of Classification Search
CPC ..... B21D 22/02; B21D 22/022; B21D 37/16; B05B 1/02; B05B 1/06; B05B 1/26; B05B 1/262
See application file for complete search history.

(56) References Cited

U.S. PATENT DOCUMENTS 2,105,154 A * 1/1938 Maxon ..... B05B 1/06 239/461
2,943,798 A 7/1960 Rienks
(Continued)

FOREIGN PATENT DOCUMENTS

CN 101394950 A 3/2009
EP 1386668 A1 2/2004
(Continued)

OTHER PUBLICATIONS

Partial English Translation of Office Action dated May 14, 2015 in Japanese Patent Application No. 2013-118993.

*Primary Examiner* — Debra M Sullivan
(74) *Attorney, Agent, or Firm* — Sughrue Mion, PLLC

(57) ABSTRACT

A spray nozzle (10) of a press apparatus includes a nozzle main body (11) having a through-hole (12), and a diffusion member (13) provided inside the through-hole (12). The diffusion member (13) includes a protruding portion (22) that diffuses coolant that flows through the through-hole (12), by interfering with the coolant.

3 Claims, 2 Drawing Sheets

(51) Int. Cl.

| | |
|---|---|
| ***B21D 22/02*** | (2006.01) |
| ***B21D 22/20*** | (2006.01) |
| *B05B 1/06* | (2006.01) |

(56) References Cited

U.S. PATENT DOCUMENTS

| | | | | |
|---|---|---|---|---|
| 3,462,085 | A * | 8/1969 | Nugarus | B05B 1/06 239/515 |
| 2004/0112976 | A1 | 6/2004 | Galvin et al. | |
| 2009/0013749 | A1 | 1/2009 | Ishimori et al. | |
| 2014/0103147 | A1* | 4/2014 | Dodson | B05B 1/02 239/597 |

FOREIGN PATENT DOCUMENTS

| | | | |
|---|---|---|---|
| EP | 1671715 | A1 | 6/2006 |
| JP | 02-191562 | A | 7/1990 |
| JP | 05-140973 | A | 6/1993 |
| JP | 2007-229772 | A | 9/2007 |
| SU | 935166 | A1 | 6/1982 |
| WO | 95/19504 | A1 | 7/1995 |
| WO | 95/30488 | A1 | 11/1995 |
| WO | 2013/001630 | A1 | 1/2013 |

* cited by examiner

PRESS APPARATUS AND SPRAY NOZZLE

BACKGROUND OF THE INVENTION

1. Field of the Invention

The invention relates to a press apparatus that press-forms a steel sheet with a forming die, and a spray nozzle mounted to this press apparatus.

2. Description of Related Art

Typically, with vehicle parts and the like, a method for manufacturing a molded article by press-forming a steel sheet with a forming die is used. In this method, when press-forming a heated steel sheet, a method that involves quenching by cooling the steel sheet by spraying coolant onto the steel sheet from the forming die is employed. Therefore, a related press apparatus includes a supply passage that is provided inside a forming die and to which coolant is supplied, a spray hole that is communicated with the supply passage and is formed in a contact surface of the forming die that contacts the steel sheet, and a spray nozzle that is mounted to the spray hole. When coolant is supplied to the supply passage of the forming die when cooling the steel sheet, the coolant passes through the supply passage and is sprayed from the spray nozzle onto the steel sheet.

However, with the related press apparatus, a diffusion angle of the coolant from the spray nozzle is small so cooling efficiency is poor, which is problematic. To increase the diffusion angle of the coolant from the spray nozzle, it is necessary to increase the shape accuracy within the spray nozzle, which will lead to an increase in cost. In addition, when the shape accuracy within the spray nozzle is increased, the durability of the spray nozzle becomes a concern. Furthermore, 50 to 200 spray nozzles are used for one set of forming dies, so an increase in the cost of a single spray nozzle will greatly affect equipment costs.

Japanese Patent Application Publication No. 2007-229772 (JP 2007-229772 A) describes a hot forming die that press-forms a heated steel sheet (i.e., a compact), and cools the compact by spraying coolant onto it. This hot forming die includes a main supply passage through which coolant passes, a plurality of branch supply passages that branch off from the main supply passage and include spray ports that spray the coolant inside the die, and a nozzle member that is fixed to the spray port side of each of the branch supply passages, and limits the amount of coolant that passes through it using a passing hole through which the coolant passes.

However, with the hot forming die according to the invention described in JP 2007-229772 A, the diffusion angle of the coolant from the nozzle member is unable to be increased simply by fixing a nozzle member having a passing hole to the spray port, so the aforementioned problem is unable to be solved.

SUMMARY OF THE INVENTION

The invention provides a press apparatus and spray nozzle capable of increasing the diffusion angle of a liquid such as coolant.

A first aspect of the invention relates to a press apparatus including a forming die with which a steel sheet is press-formed and a spray nozzle mounted to a spray hole provided in the forming die, for spraying coolant toward the steel sheet. The spray nozzle includes a nozzle main body having a through-hole, and a diffusion member provided inside the through-hole. The diffusion member includes a diffusing portion that diffuses coolant that flows through the through-hole, by interfering with the coolant, and a retaining portion that retains the diffusion member inside the through-hole. Accordingly, a diffusion angle of a liquid such as coolant from the spray nozzle is able to be increased.

Various modes of the press apparatus and spray nozzle of the invention, as well as the operation thereof, will now be described in detail.

A first aspect of the invention relates to a press apparatus that press-forms a steel sheet with a forming die, and that includes a spray nozzle mounted to a spray hole provided in the forming die, for spraying coolant toward the steel sheet. The spray nozzle includes a nozzle main body having a through-hole, and a diffusion member provided inside the through-hole. The diffusion member includes a diffusing portion that diffuses coolant that flows through the through-hole, by interfering with the coolant, and a retaining portion that retains the diffusion member inside the through-hole. With this press apparatus, the coolant that flows through the through-hole of the nozzle main body interferes with the diffusing portion and is sprayed diffused along the diffusing portion. Also, the diffusion member is retained in the through-hole by the retaining portion so as not to slip out of the through-hole.

The diffusing portion may include a protruding portion that is integrally provided on an end portion of a rod-shaped portion inserted into the through-hole, and that protrudes radially outward from the rod-shaped portion. The coolant flows through an annular passage to the outside of the rod-shaped portion inside the through-hole, and the coolant that has flowed through the annular passage interferes with the protruding portion of the diffusion member and is sprayed diffused along an outer wall surface of the protruding portion.

The through-hole may include a large diameter hole within which the protruding portion is arranged, a small diameter hole into which the rod-shaped portion is inserted, and a tapered surface that is provided between the large diameter hole and the small diameter hole, and that increases in diameter toward the large diameter hole. With this press apparatus, coolant that has interfered with the diffusing portion of the diffusion member is sprayed smoothly diffused by flowing along the tapered surface provided on the through-hole.

The rod-shaped portion may be formed in a pair opposing each other, and the retaining portion may include a tapered portion that is unable to fit into the small diameter hole, and is provided on an end portion of each of the pair of rod-shaped portions, which is on a side opposite the protruding portion. With this press apparatus, the diffusion member will not slip out of the through-hole when coolant flows through the through-hole of the spray nozzle.

The protruding portion may include a circular portion that is generally circular when viewed from a side, and that is integrally provided on each end portion of the pair of rod-shaped portions. With this press apparatus, the protruding portion is able to be formed easily.

The end portion of the small diameter hole is formed with a tapered surface that increases in diameter toward an end surface of the nozzle main body. As a result, the tapered portion provided on the diffusion member is able to be housed easily.

The diffusion member may also be a split pin. The diffusion member may be substituted with a split pin that is an existing product, so the cost is able to be less expensive.

A second aspect of the invention relates to a spray nozzle mounted to a spray hole for spraying a liquid. This spray nozzle includes a nozzle main body having a through-hole, and a diffusion member provided inside the through-hole. The diffusion member includes a diffusing portion that diffuses liquid that flows through the through-hole by interfering with the liquid, and a retaining portion that retains the diffusion member inside the through-hole. With this spray nozzle, liquid that flows through the through-hole of the nozzle main body interferes with the diffusing portion and is sprayed diffused along the diffusing portion. Also, the diffusion member is retained inside the through-hole by the retaining member so as not to slip out.

The invention makes it possible to provide a press apparatus and a spray nozzle that increases the diffusion angle of a liquid such as coolant.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
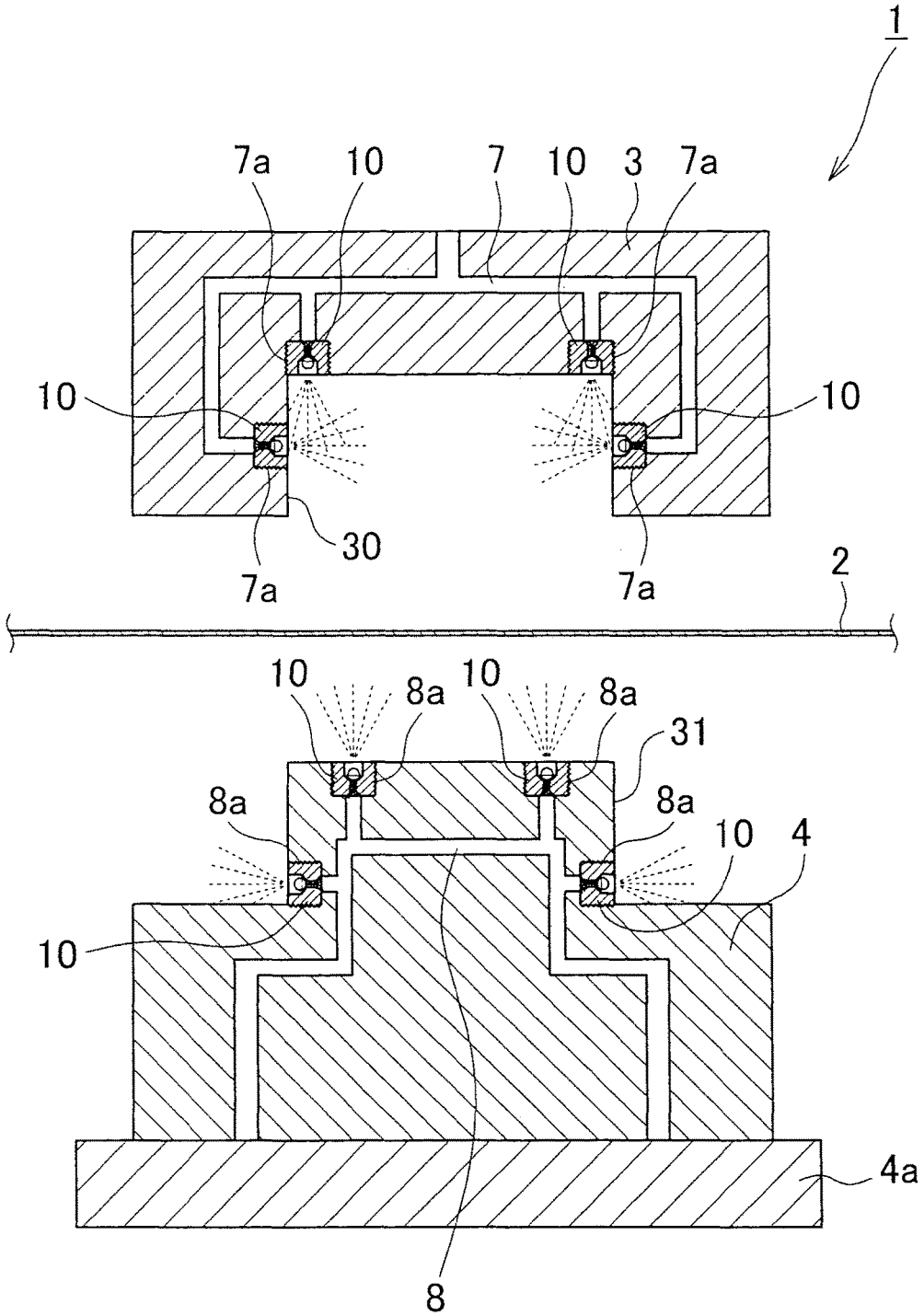
FIG. 1 is a schematic of a press apparatus according to one example embodiment of the invention.

Modes for carrying out the invention will now be described in detail with reference to FIGS. 1 and 2. A press apparatus 1 according to one example embodiment of the invention includes an upper die (forming die) 3 and a lower die (forming die) 4 that press-form a heated steel sheet 2, as shown in FIG. 1. The upper die 3 is able to move in the vertical direction in FIG. 1 by driving force from a driving source, not shown, being transmitted. On the other hand, the lower die 4 is fixed to a plate 4*a*. An upper die supply passage 7 for supplying coolant is formed inside the upper die 3. A lower die supply passage 8 for supplying coolant is also formed inside the lower die 4. A plurality of spray holes 7*a* (four locations are shown in FIG. 1) that are communicated with the upper die supply passage 7 are formed in a surface of the upper die 3 that contacts the steel sheet 2. A plurality of spray holes 8*a* (four locations are shown in FIG. 1) that are communicated with the lower die supply passage 8 are also formed in a surface of the lower die 4 that contacts the steel sheet 2. An internal thread is formed on an inner peripheral surface of each of the spray holes 7*a* and 8*a* of the upper die 3 and the lower die 4. A spray nozzle 10 is screwed into each of the spray holes 7*a* and 8*a* of the upper die 3 and the lower die 4.

Figure 2:
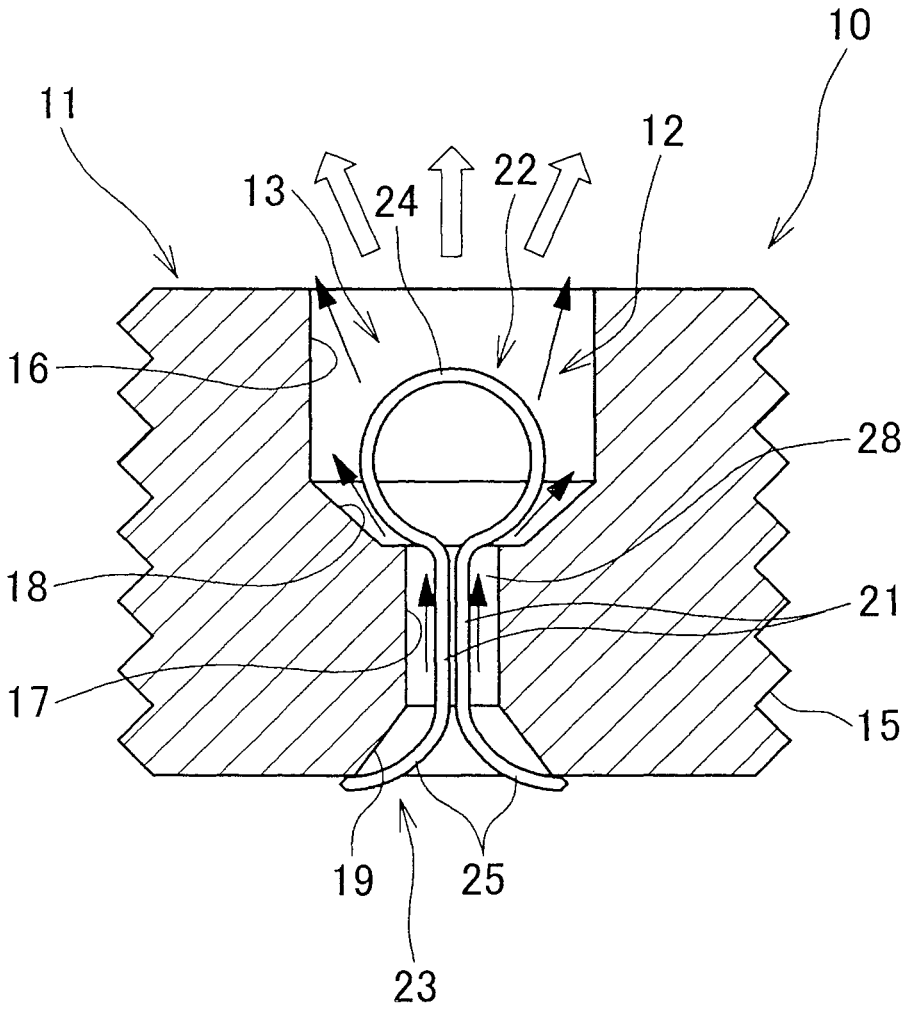
FIG. 2 is a sectional view of a spray nozzle used in the spray apparatus in FIG. 1.

The spray nozzle 10 includes a nozzle main body 11 that is formed in a cylindrical shape and has a through-hole 12, and a diffusion member 13 provided inside the through-hole 12 of the nozzle main body 11, as shown in FIG. 2. An external thread 15 that screws together with the internal thread of the spray holes 7*a* and 8*a* of the upper die 3 and the lower die 4 is formed on an outer peripheral surface of the nozzle main body 11. The through-hole 12 includes a large diameter hole 16 that is positioned on a downstream side in the flow direction of the coolant and is open to a downstream side end surface of the nozzle main body 11, a small diameter hole 17 that is position on the upstream side and is open to an upstream side end surface of the nozzle main body 11, a first tapered surface 18 that is provided between the large diameter hole 16 and the small diameter hole 17, and increases in diameter toward the large diameter hole 16, and a second tapered surface 19 that is provided on an upstream side end portion of the small diameter hole 17, and increases in diameter toward the upstream side end surface of the nozzle main body 11. The large diameter hole 16 and the small diameter hole 17 are both formed in a circular shape when viewed from above. The white arrows in FIG. 2 indicate the flow direction of the coolant.

As shown in FIG. 2, the diffusion member 13 includes a pair of opposing rod-shaped portions 21 that are inserted into the small diameter hole 17 of the nozzle main body 11, a protruding portion 22 that serves as a diffusing portion that is integrally provided on a downstream side end portion of the pair of rod-shaped portions 21 and protrudes radially outward from the pair of rod-shaped portions 21, and a retaining portion 23 that retains the diffusion member 13 inside the through-hole 12 of the nozzle main body 11 so that it (i.e., the diffusion member 13) will not slip out. The size of the sectional area of the pair of rod-shaped portions 21 is sufficiently smaller than the sectional area of the small diameter hole 17. The protruding portion 22 is formed by a circular portion 24 that is generally circular when viewed from a side, and that integrally extends continuous with each downstream side end portion of the pair of rod-shaped portions 21. The outside diameter of the circular portion 24 is smaller than the inside diameter of the large diameter hole 16 and larger than the inside diameter of the small diameter hole 17. The retaining portion 23 is formed by a pair of tapered portions 25 that are integrally provided one on each of the upstream side end portions of the pair of rod-shaped portions 21, and are unable to fit through the small diameter hole 17. That is, because the distance between the tip ends of the tapered portions 25 is larger than the inside diameter of the small diameter hole 17, the diffusion member 13 will not slip out of the through-hole 12 even if it receives pressure in the flow direction of the coolant.

Next, a method for forming the spray nozzle 10 by assembling the diffusion member 13 into the through-hole 12 of the nozzle main body 11 will be described. First, the diffusion member 13 that includes the pair of rod-shaped portions 21, and the circular portion 24 integrally provided on the downstream side end portion of the pair of rod-shaped portions 21, is prepared. At this time, the diffusion member 13 may be substituted with a split pin that is an existing product. Continuing on, the diffusion member 13 is inserted into the small diameter hole 17 of the nozzle main body 11 from the side with the pair of rod-shaped portions 21. When this is done, the circular portion 24 of the diffusion member 13 is housed inside the large diameter hole 16 so as to abut against the downstream end portion of the small diameter hole 17 of the nozzle main body 11 (i.e., so as to cover a portion of the downstream side opening of the small diameter hole 17), and each tip end portion (i.e., upstream side end portion) of the pair of rod-shaped portions 21 protrudes slightly from the upstream side end surface of the nozzle main body 11. Then, the tapered portions 25 are formed by crimping the tip end portions of the pair of rod-shaped portions 21 so that they spread out in the radial direction, using a tool, not shown, thus completing the manufacture of the spray nozzle 10.

Next, the operation of the press apparatus 1 according to the example embodiment of the invention will be described. First, a plurality of the spray nozzles 10 are prepared, and the spray nozzles 10 are attached by being screwed into the spray holes 7*a* provided in the upper die 3 and the spray holes 8*a* provided in the lower die 4. Then the steel sheet 2 that has been heated at approximately 900° C. is transported by a transport mechanism, not shown, to in between the upper die 3 and the lower die 4. Next, the upper die 3 is lowered, and a protruding portion 31 of the lower die 4 engages with a recessed portion 30 of the upper die 3 such that the steel sheet 2 is sandwiched in between. At this time, at the stage in which the upper die 3 is lowered to a forming intermediate position, coolant is supplied to the upper die supply passage 7 of the upper die 3 and to the lower die supply passage 8 of the lower die 4. Then the coolant is sprayed toward the steel sheet 2 from the spray nozzles 10 that are screwed into the spray holes 7*a* and 8*a* of the upper die 3 and the lower die 4. When the coolant passes through the spray nozzles 10, the coolant flows through an annular passage 28 between an outer wall surface of the pair of rod-shaped portions 21 of the diffusion member 13 and an inner wall surface of the small diameter hole 17. Some of the coolant that has flowed through the annular passage 28 interferes with the outer wall surface of the circular portion 24 of the diffusion member 13, and flows along the first tapered surface 18 of the through-hole 12, and is sprayed diffused from the large diameter hole 16, as shown by the arrows in FIG. 2. Also, a nominal amount of coolant flows between the pair of rod-shaped portions 21 and is sprayed out through openings in the circular portion 24. As a result, the diffusion angle of coolant from the spray nozzle 10 is able to be larger than it is conventionally. The diffusion member 13 includes the tapered portions 25 as the retaining portion 23, so when the coolant passes through the through-hole 12, the diffusion member 13 will not slip out of the through-hole 12 even if it (i.e., the diffusion member 13) receives pressure from the coolant.

Next, coolant stops being supplied to the upper die supply passage 7 of the upper die 3 and the lower die supply passage 8 of the lower die 4 when the upper die 3 is lowered to bottom dead center. As a result, the steel sheet 2 is able to be press-formed in a hat-shape, as well as quenched.

As described above, the spray nozzle 10 used in the press apparatus 1 according to the example embodiment of the invention includes the nozzle main body 11 having the through-hole 12, and the diffusion member 13 provided in the through-hole 12. The diffusion member 13 includes the protruding portion 22 (i.e., the diffusing portion) that is arranged abutting against the downstream side end portion of the small diameter hole 17 of the through-hole 12, and interferes with the coolant from the small diameter hole 17, thereby diffusing the coolant. Consequently, when the coolant passes through the spray nozzle 10, some of the coolant that has flowed through the small diameter hole 17 of the through-hole 12 is sprayed diffused by it (i.e., the coolant) interfering with the protruding portion 22 (i.e., the circular portion 24) of the diffusion member 13. As a result, the diffusion angle is able to be larger than it is with a nozzle member provided in the related press apparatus, so the cooling efficiency of the steel sheet 2 is able to be improved.

Also, with the spray nozzle 10 used in the press apparatus 1 according to the example embodiment of the invention, the through-hole 12 of the nozzle main body 11 includes the first tapered surface 18 that increases in diameter toward the large diameter hole 16, between the large diameter hole 16 positioned on the downstream side and the small diameter hole 17 positioned on the upstream side. Therefore, the diffusion angle is able to be made as large as possible by the coolant that has flowed through the small diameter hole 17 and interfered with the protruding portion 22 (i.e., the circular portion 24) of the diffusion member 13, flowing along the first tapered surface 18.

In this example embodiment, a mode in which the spray nozzle 10 is used in the press apparatus 1 is employed, but the spray nozzle 10 may also be used mounted to a liquid-spraying spray hole of another apparatus.

The invention claimed is:

1. A press apparatus comprising:

a forming die with which a steel sheet is press-formed, wherein the forming die includes a spray hole; and a spray nozzle mounted in the spray hole, wherein the spray nozzle includes a nozzle main body having a through-hole, and a diffusion member provided partially inside the through-hole, for spraying coolant toward the steel sheet, wherein the diffusion member is a split pin, including a diffusing portion, a retaining portion, and a pair of rod-shaped portions connected to the diffusing portion and the retaining portion, wherein the diffusing portion diffuses coolant that flows through the through-hole, by interfering with the coolant, the diffusing portion including a protruding portion integrally formed with a downstream end of each of the pair of rod-shaped portions so as to protrude radially outward from the pair of rod-shaped portions, wherein the protruding portion includes a circular portion, and the retaining portion is attached to an upstream end of each of the pair of rod-shaped portions so as to retain the diffusion member inside the through-hole.

2. The press apparatus according to claim 1, wherein the through-hole includes a large diameter hole within which the protruding portion is arranged, a small diameter hole into which the pair of rod-shaped portions is inserted, and a tapered surface that is provided between the large diameter hole and the small diameter hole, and that increases in diameter toward the large diameter hole.

3. A spray nozzle mounted to a spray hole for spraying a liquid, comprising:

a nozzle main body having a through-hole; and a diffusion member that is provided partially inside the through-hole, wherein the diffusion member is a split pin, including a diffusing portion, a retaining portion, and a pair of rod-shaped portions connected to the diffusing portion and the retaining portion, wherein the diffusing portion diffuses liquid that flows through the through-hole, by interfering with the liquid, the diffusing portion including a protruding portion integrally formed with a downstream end of each of the pair of rod-shaped portions so as to protrude radially outward from the pair of rod-shaped portions, wherein the protruding portion includes a circular portion, and the retaining portion is attached to an upstream end of each of the pair of rod-shaped portions so as to retain the diffusion member inside the through-hole.

* * * * *